US006826913B2

(12) United States Patent
Wright

(10) Patent No.: US 6,826,913 B2
(45) Date of Patent: Dec. 7, 2004

(54) AIRFLOW MODULATION TECHNIQUE FOR LOW EMISSIONS COMBUSTORS

(75) Inventor: E. Scott Wright, Tempe, AZ (US)

(73) Assignee: Honeywell International Inc., Morristown, NJ (US)

( * ) Notice: Subject to any disclaimer, the term of this patent is extended or adjusted under 35 U.S.C. 154(b) by 121 days.

(21) Appl. No.: 10/286,148

(22) Filed: Oct. 31, 2002

(65) Prior Publication Data

US 2004/0083737 A1 May 6, 2004

(51) Int. Cl.[7] ..... F02C 1/00
(52) U.S. Cl. ..... 60/772; 60/752; 60/754
(58) Field of Search ..... 60/772, 773, 752, 60/754, 755, 756, 757, 758, 760, 39.23

(56) References Cited

U.S. PATENT DOCUMENTS

| | | | | |
|---|---|---|---|---|
| 3,747,336 A | * | 7/1973 | Debelius et al. | 60/39.55 |
| 3,910,035 A | | 10/1975 | Juhasz et al. | |
| 4,054,028 A | | 10/1977 | Kawaguchi | |
| 4,062,182 A | | 12/1977 | Fehler et al. | |
| 4,157,010 A | | 6/1979 | Sailer | |
| 4,446,692 A | | 5/1984 | Adkins | |
| 4,628,687 A | | 12/1986 | Ström | |
| 4,928,481 A | * | 5/1990 | Joshi et al. | 60/737 |
| 5,013,236 A | * | 5/1991 | Khinkis | 431/10 |
| 5,199,255 A | * | 4/1993 | Sun et al. | 60/772 |
| 5,687,572 A | * | 11/1997 | Schrantz et al. | 60/753 |
| 5,735,126 A | * | 4/1998 | Schulte-Werning | 60/732 |
| 6,134,877 A | * | 10/2000 | Alkabie | 60/800 |
| 6,370,862 B1 | * | 4/2002 | Cheng | 60/775 |

* cited by examiner

*Primary Examiner*—Justine R. Yu
*Assistant Examiner*—William H. Rodriguez
(74) *Attorney, Agent, or Firm*—Robert Desmond, Esq.

(57) ABSTRACT

The present invention is directed to a fluidic system and method for controlling the airflow to a lean premix combustor. The system and method as disclosed allow for reduced power, which results in reduced emissions, while at the same time providing excellent performance. This is accomplished through the use of fluidic means, which do not have the problems associated with hot moving parts of prior art mechanical means. Specifically, the introduction of an airflow downstream from openings in the dilution section cause a local boundary layer separation forcing air into the dilution holes.

20 Claims, 3 Drawing Sheets

AIRFLOW MODULATION TECHNIQUE FOR LOW EMISSIONS COMBUSTORS

BACKGROUND OF THE INVENTION

The present invention generally relates to a method and system for improving the performance of a gas turbine engine by varying the combustor airflow using non-mechanical means.

The conventional gas turbine combustor, as used in a gas turbine power generating system, requires a mixture of fuel and air which is ignited and combusted uniformly. Generally, the fuel injected from a fuel nozzle into the inner tube of the combustor is mixed with air for combustion, fed under pressure from the air duct, ignited by a spark plug and combusted. The gas that results is lowered to a predetermined turbine inlet temperature by the addition of cooling air and dilutent air, then injected through a turbine nozzle into a gas turbine.

The supply of air from the engine compressor to the combustion chamber is usually divided into two main flows: combustion and dilution flow. Combustion flow is usually fed upstream to primary and secondary zones. Dilution air is usually fed through a series of apertures in the downstream end of the chamber to cool the hot gases from the combustion zone to a temperature acceptable to the turbine and such that the gases are at a uniform temperature.

It is well known within the art that exhaust gases produced by combusting hydrocarbon fuels can contribute to atmospheric pollution. This occurrence is attributed to the development of a localized high temperature zone, which can exceed 2,000° C. Exhaust gases typically contain many undesirable pollutants such as nitric oxide (NO) and nitrogen dioxide ($NO_2$), which are frequently grouped together as Nitrogen Oxides ($NO_x$), unburned hydrocarbons (UHC), carbon monoxide (CO), and particulates, primarily carbon soot.

Several methods are known in the art to decrease $NO_x$ emissions. For example, the formation of $NO_x$ can be reduced by burning a low nitrogen or nitrogen-free fuel. The formation of $NO_x$ can be reduced by operating under uniformly fuel-lean conditions, such as by using a lean diffusion flame or a lean premixed/prevaporized (LPP) system. The excess air used to achieve fuel-lean combustion acts as a diluent to lower flame temperatures, thereby reducing the amount of thermal $NO_x$ formed. Prompt $NO_x$ can also be reduced by operating under fuel-lean conditions.

Generally CO pollutants are formed at low power conditions and $NO_x$ pollutants are formed at high power conditions. This leads to the problem that methods of reducing CO tend to increase amounts of $NO_x$ created. Likewise, efforts to decrease $NO_x$ emissions generally cause an increase in CO conditions.

For example, a convenient way of reducing the maximum temperature and therefore the formation of $NO_x$, a problem which is acute in high pressure ratio engines where the combustion temperature is increased by the higher temperature of the supply air, is to operate the combustion primary section at an off-stoichiometric mixture strength, since the formation of $NO_x$ is at a maximum when the air and fuel mixture is stoichiometric and decreases rapidly as the mixture is richened or weakened. Thus $NO_x$ can be reduced provided the equivalence ratio is greater than 1.2 (fuel rich) or less than 0.8 (fuel weak).

However, this solution leads to a further problem, because when the engine operates at a part load condition there is a tendency for the equivalence ratio and the compressor delivery air temperature to drop causing the emission of large quantities of CO and the likelihood of combustion instability. A solution to this problem is to control the air to fuel ratios in the flame tube to suit the varying operating conditions. In this way the best compromise between combustion efficiency and the production of exhaust gas pollutants, and exit temperature can be achieved. This desirable state is achievable, either by the method known as fuel staging or by the method of regionally controlling the division of the air.

U.S. Pat. No. 4,062,182 to Fehler et al, herein incorporated by reference, provides a good example of the practice of fuel staging. Fuel staging involves the placing of air: fuel mixtures of known ratios into selected portions of the combustion zone. It usually involves at least two independently controllable stages of fuel injectors and a corresponding number of groups of air and fuel inlets into the combustion zone for the passage of two or more independent air and fuel mixture flows. By this method the combustion zone can be divided up into a first portion in which the air: fuel mixture is fuel rich as required for good ignition, the engine starting cycle and the lean mixture stalling limit and a second portion in which the air and fuel mixture is air rich to provide the lower combustion temperature. The net result of this arrangement is to achieve the desired lower bulk combustion temperatures and so keep the NOx emissions at an acceptable level whilst still being able to operate at low power conditions without generating substantial quantities of CO. The disadvantage of such an arrangement is the complexity of the fuel supply, in that at least two separately controllable fuel supply systems are required each having to be able to be assembled and disassembled with respect to the combustor and requiring relatively large apertures in the engine casing for such purposes. Any mechanical means of controlling the air supply is inherently fraught with problems associated with clogging and added complexity.

As can be seen, there is a need for a system and method for controlling and modulating the airflow to a lean premix combustor that allows for reduced power and reduced emissions.

SUMMARY OF THE INVENTION

The present invention is directed to a fluidic system and method for controlling the airflow to a lean premix combustor. The system and method as disclosed allows for reduced power, which results in reduced emissions, while at the same time providing excellent performance. This is accomplished through the use of fluidic means, which do not have the problems associated with hot moving parts of prior art mechanical means.

In one aspect of the invention is a gas turbine engine combustion system for varying the fuel/air ratio, comprising an inner shell with a premix section, a primary section, and a dilution section. There may be an outer shell accommodating the inner shell, a heat shield interposed between the outer shell and the inner shell, wherein the heat shield has a multiplicity of small holes. A casing may be attached to the heat shield and surrounding each of multiplicity of small holes. There may be a passage between the inner shell and the heat shield. The dilution section of the inner shell may have at least two dilution holes, which allow air to flow into said dilution section.

In another aspect of the present invention, a gas turbine engine combustion system for varying the fuel/air ratio is disclosed comprising an inner shell with a premix section, a primary section, and a dilution section. An outer shell accommodating the inner shell, and a heat shield may be interposed between the outer shell and the inner shell. The heat shield may have at least one set of small holes. An annular casing may be attached to the heat shield and surrounding at least one set of small holes. There may also be an annular passage between the inner shell and the heat shield and at least one set of dilution holes in the dilution section of said inner shell, wherein said at least one set of small holes in the heat shield are opposite and downstream from at least one set of dilution holes.

In another aspect of the present invention, a combustion chamber for varying air flow within a lean premix combustor engine is disclosed comprising an inner shell with a premix section, a primary section and a dilution section, an outer shell accommodating the inner shell and a heat shield interposed between the outer shell and the inner shell. The heat shield may have a first set of small holes and a second set of small holes. The first set of small holes may be parallel to the second set of small holes. There may also be an annular casing attached to the heat shield and surrounding the first set of small holes. There may also be an annular casing attached to the heat shield and surrounding the second set of small holes. An annular passage between the inner shell and the heat shield is also disclosed. A first set of dilution holes in the dilution section of the inner shell may be opposite and downstream from the first set of small holes. A second set of dilution holes in the dilution section of the inner shell may be opposite and downstream from the second set of small holes. Turbulation ribs may be attached to the outside of the inner shell and downstream from the dilution holes.

In yet another aspect of the present invention, there is disclosed a method of modulating the airflow to effectuate a desired fuel/air ratio in a lean premix combustor. This method may comprises the steps of reducing power, which reduces fuel flow into the combustor, reducing air into a primary section, cooling an inner shell by convective cooling and increasing air into a dilution section by introducing at least one stream of air through a multiplicity of openings in a heat shield that is interposed between and inner shell and an outer liner. The openings in the heat shield may be downstream from a multiplicity of dilution holes in an inner shell. At least one stream of air causes a local boundary layer separation to encourage blockage just below the said multiplicity of dilution holes so as to encourage air to enter said multiplicity of dilution holes.

In yet another aspect of the present invention, a method of modulating the airflow to effectuate a desired fuel/air ratio in a lean premix combustor is disclosed comprising the steps of reducing power, which reduces fuel flow Into the combustor; reducing air into a primary section, cooling an inner shell by convective cooling and increasing air into a dilution section by introducing at least one stream of air through a multiplicity of openings in a heat shield that is interposed between and inner shell and an outer liner. The openings in the heat shield are downstream from a multiplicity of dilution holes in an inner shell and at least one stream of air causes a local boundary layer separation to encourage blockage just below the multiplicity of dilution holes so as to encourage air to enter dilution holes.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally relates to a fluidic method and system for modulating air flow within a combustion chamber of a gas turbine engine. The invention may be used with a lean premix combustor to modulate the amount of air into the various sections of the combustor. The present invention overcomes the previous attempts to modulate the amount of air that have relied on mechanical means and fluid means that have failed to successfully introduce air at the proper conditions into the dilution section.

Figure 1:
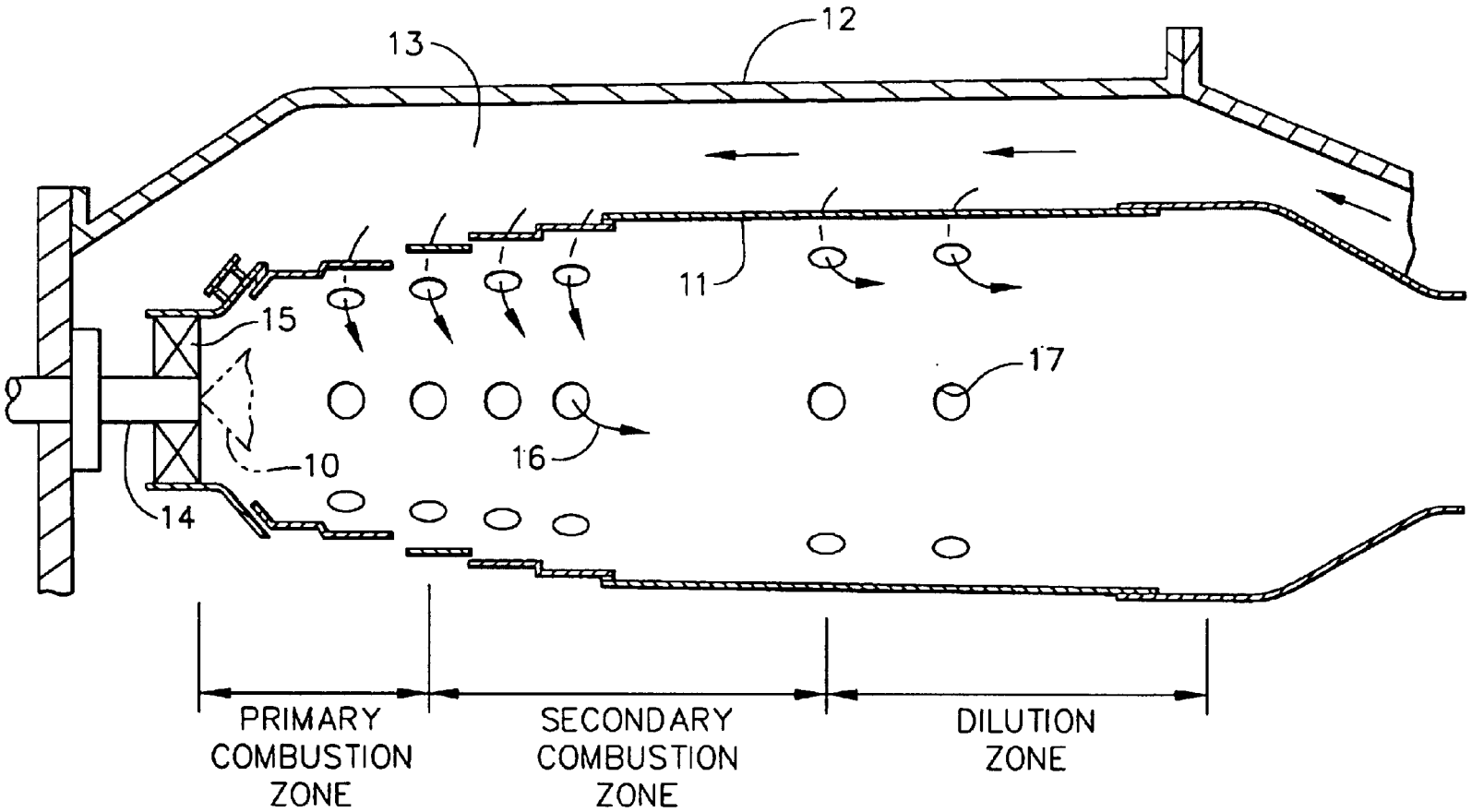
FIG. 1 (PRIOR ART)
FIG. 1 is a sectional view of a conventional fuel combustion apparatus.

FIG. 1 depicts a conventional fuel combustor, which comprises an inner shell 11 and an outer shell 12 accommodating the inner shell 11, so that fuel for combustion may be supplied leftward from the right end into an annular passage 13 formed between the Inner shell 11 and the outer shell 12 At the head of the inner shell 11 is installed a fuel injection valve 14, which is surrounded by an air supply port 15 equipped with swirl blades. The inner shell 11 is formed with a plurality of air holes 16 and 17. Fuel is injected under pressure, generally in the form of a cone (as indicated at 10), from the fuel injection valve 14 into the inner shell 11. Air for combustion is supplied from the annular passage 13 into the inner shell 11 through the air supply port 15 and air holes 16 to permit the combustion of fuel. While air is also supplied from the air holes 17, it is intended for use as dilution air that will maintain the gas burning within the inner shell 11 at a predetermined temperature.

This combustion apparatus has a number of disadvantages, including: mixing of air and fuel in the vicinity of the injected fuel cone 10 that governs the smoke and $NO_x$, production is not uniform, localized adjustment of the mixing condition not feasible; the fuel/air ratio does not correspond to changes in the load, and the smoke and $NO_x$ production is high when the apparatus operates at heavy loads. Also, the combustion tends to be instable with difficulty of ignition and frequent blow-out since a large volume of air is supplied around the injected fuel cone 10 for low-pollution combustion of a lean mixture. Another disadvantage may be many air holes, formed in a number of rows in the wall of the inner shell, which may limit the penetration of air centripetally of the shell resulting in poor air fuel mixing. Because the air holes are formed in succession in the wall of the inner shell, there may be no clear distinction between primary and secondary combustion zones.

Figure 2:
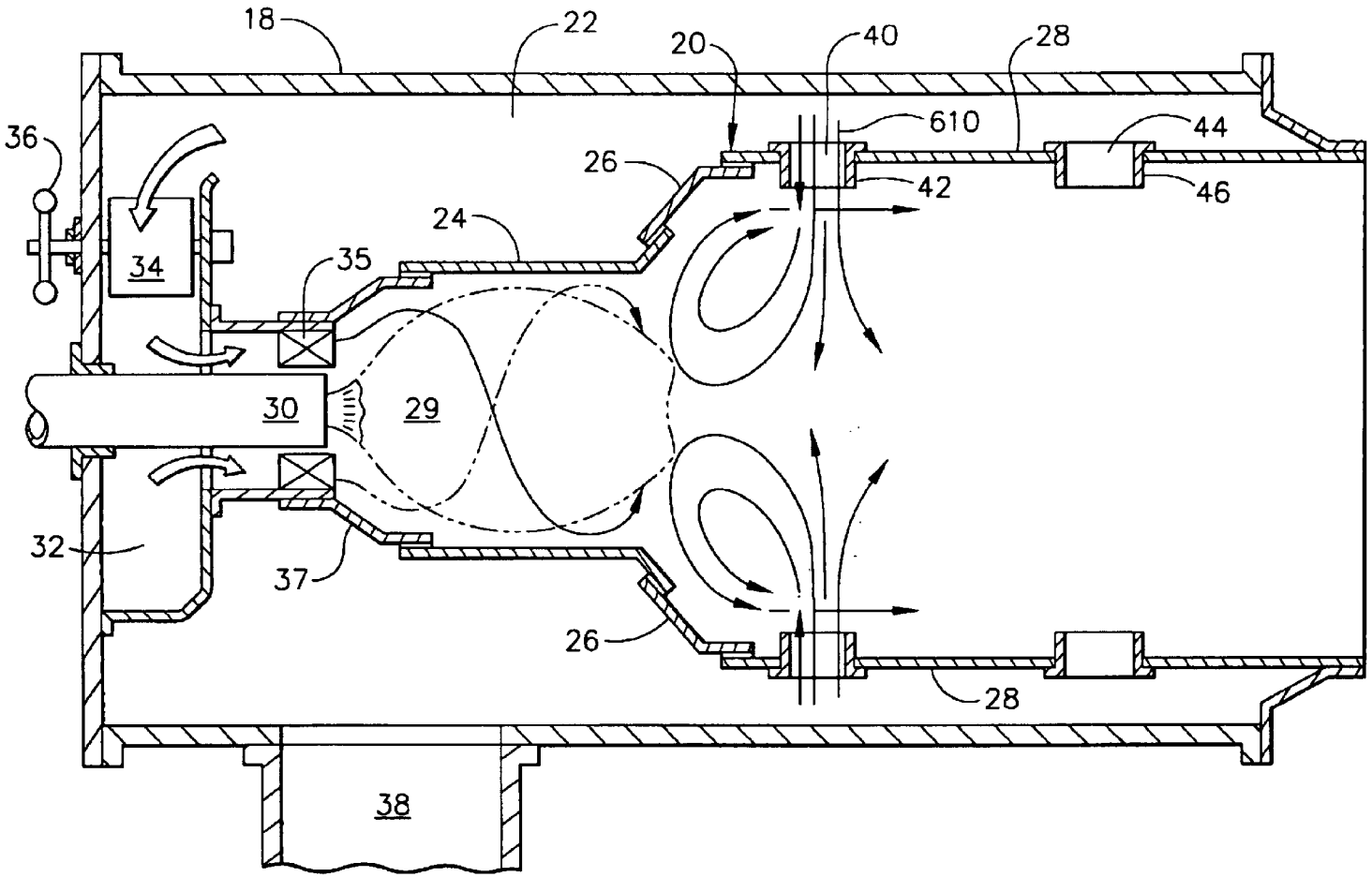
FIG. 2 (PRIOR ART)
FIG. 2 is a sectional view of a fuel combustion apparatus as in the prior art.

FIG. 2 depicts a cross-sectional view of another prior art embodiment. An outer shell 18 accommodates a coaxial inner shell 20, defining an annular space 22 there between. The coaxial inner shell 20 consists of a small-diameter section 24, a large-diameter section 28, and a conically-shaped connecting section 26 between the two sections of different diameters.

A fuel injection valve 30 is installed at the end of the outer shell and opens in one end portion of the small-diameter section 24. Around the fuel injection valve 30 there is a swirler 35 having swirl blades 16 for supplying air for combustion to the coaxial inner shell 20. On the upstream side of the swirler 35 is formed an air chamber 32, and an air control vane 34 is mounted in the space communicating the air chamber 32 with the annular space 22 to control the amount of air to be supplied. The air control vane 34 is manipulatable from the outside of the outer shell 18 by means of an operating handle 36. An air supply pipe 38, communicated at one end with the annular space 22 through the outer shell 18 and at the other end with an air source (not shown), supplies the annular space 22 with a necessary amount of air for combustion, dilution, and cooling. The wall portion of the large-diameter section 28 close to the conically-shaped connecting section 26 of the coaxial inner shell 20 is formed with a suitable number of air holes 40, each of which is shrouded with a scoop 42 extending perpendicularly to the axis of the large diameter section 28. At some distance downstream from the air holes 40, another group of holes 44 for dilution air, are formed in a suitable number through the wall of the large diameter section 28. The dilution air holes 44 are also provided with scoops 46. The small-diameter section 24 is not perforated for air supply.

In order to operate the apparatus, the air control vane 34 is adjusted so that a necessary amount of air for ignition is supplied to the swirler 35 surrounding the fuel injection valve 30. When the apparatus runs at load, the amount of air being supplied to the swirler 35 is adjusted by means of the air control vane 34, and a rich mixture is burned within the small-diameter section 24 of the coaxial inner shell 20. This small-diameter section 24 constitutes a primary combustion zone. As will be readily understood by those skilled in the art, fuel is injected from the fuel Injection valve 30 into the small-diameter section 24. Air admitted from the swirler 35 into the small-diameter section 24 (i.e., the primary combustion zone) is caused to swirl, in the direction indicated by arrows 25 within the small-diameter section 24, by the swirl blades 37 of the swirler 35. The swirling air stream moves toward the large-diameter section 28, where the swirl angle is increased with a decrease in the axial flow velocity, and the gas retention time is extended. Then, air from the holes 40, with Its penetration increased by the scoops 42, gets into the large-diameter section 28, and the unburned gas is mixed thoroughly with the air to form a uniform mixture for complete combustion. Here a secondary combustion zone 41 is formed. The gas completely burned in the secondary combustion zone 41 flows downstream, diluted and cooled by the air introduced through the dilution air holes 44 and is finally discharged from the combustion apparatus. When the load is variable, satisfactory combustion conditions can be maintained by adjusting the air control vane 34 in such a way as to keep a constant ratio of fuel to air (fuel/air ratio) in the primary combustion zone 39. The distribution of air between the primary and secondary combustion zones 41 is properly adjusted by means, such as the air control vane 34, for adjusting the flow rate of air to the primary combustion zone 39 so as to ensure ready ignitability at the start and stability of combustion.

While this prior art system represented an advancement in the art, the system has a number of disadvantages. The use of mechanical means is fraught with added complications and complexity. Specifically, there are performance, durability and reliability issues with the seal, wear and binding. Also, there are increased costs. Also, it is desirable to control the air introduced to the dilution section and introduce less air into the premixer.

Figure 3:
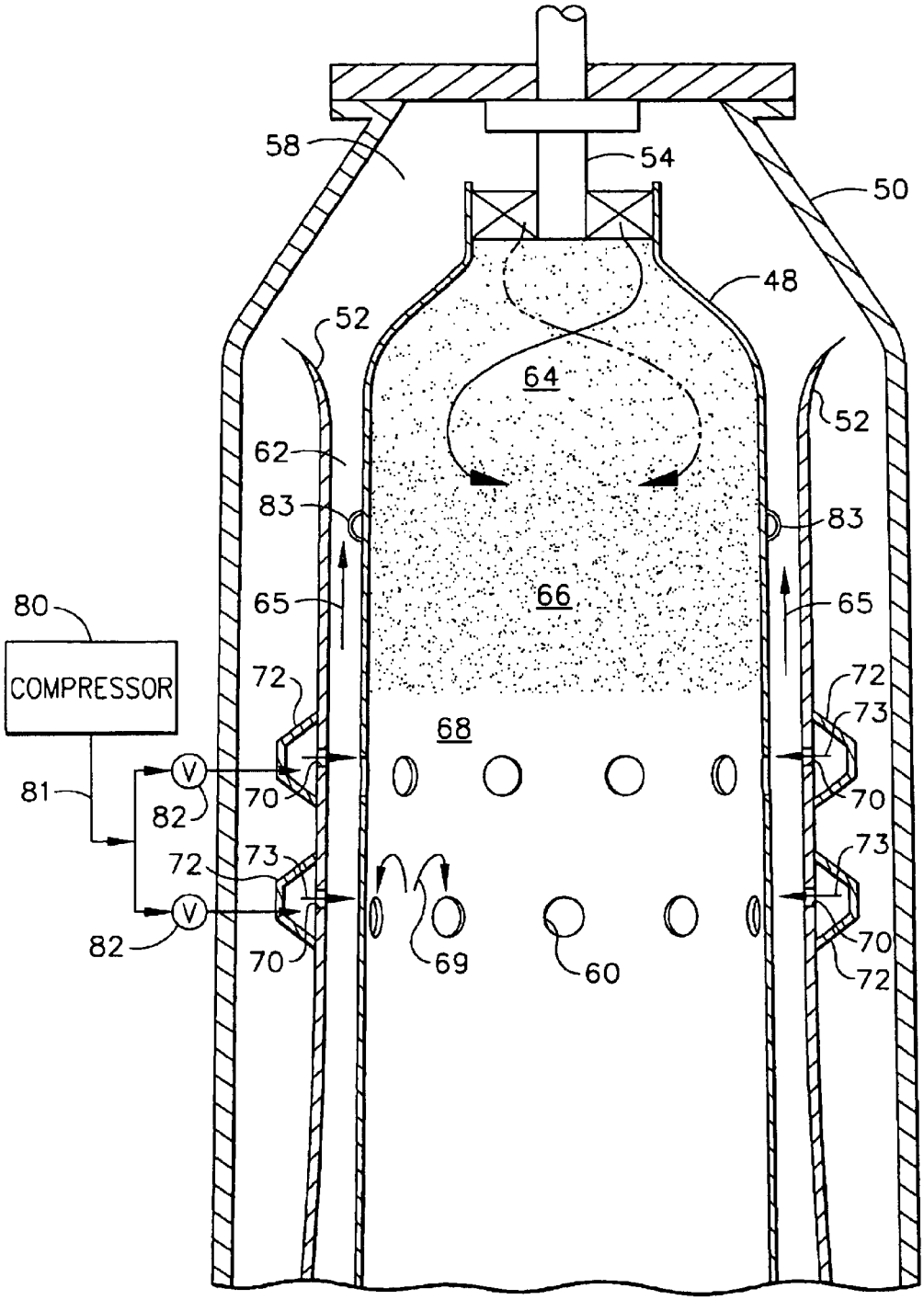
FIG. 3 is a sectional view of an apparatus as in the present invention.

FIG. 3 depicts a combustion system according to the present invention. Shown is a combustor which may comprise an inner shell 48, an outer shell 50 accommodating the inner shell 48, with a heat shield 52 interposed between the outer shell 50 and the inner shell 48. At the head of the inner shell 48 may be a fuel injection valve 54. Fuel may be injected under pressure through the fuel injection valve 54 into the premix section 64 of the inner shell 48. It should be mentioned that this combustor is intended for gaseous fuel. Liquid fuel may be used if it is gasified prior to mixing. Air for combustion may be supplied from the annular passage 58 Into the Inner shell 48 and air holes 60 permit the combustion of fuel. The combustion process in the premix section 64 may be premixed and a lean ratio. This is to say the process is not the usual diffusion flame process which burns at a stoichiometric fuel/air ratio at a temperature 4000° F. and greater. Rather, it may burn at a lower temperature around 2700° F. Because of the lower temperature, the amount of $NO_x$ produced is greatly reduced. While air may be supplied from the air holes 60, it may be intended for use as dilution air that will maintain the gas burning in the inner shell at a predetermined temperature. A portion of air flow 65 may flow through the flow channel 62 between the heat shield 52 and the inner shell 48 and into the premix section 64 and primary section 66. A portion of the air may flow 65 through the flow channel 62 and into dilutionfls holes 60. The heat shield 52 keeps the radiation from inner shell 48 from heating up the external combustor case (not shown). The flow to the combustor goes upward through the flow channel 62. At full power some of air flows through the dilution holes 60 and into the dilution section 68. The remainder of the air flows into the premix section 64. The velocity in the flow channel 62 is fairly high since this design relies on convective cooling on the external surface of the liner 48 rather than air film cooling as in conventional diffusion flame combustor. It may be desirable, though, to increase the amount of air into the dilution section 68. In this way, the fuel/air ratio may be maintained as the power and absolute fuel flow are reduced. Typical maximum power fuel/air ratios for turbine engines are about 0.013 Wf/Wa, where Wf is pounds per second mass flow of fuel and Wa pounds per second mass flow of air. The present invention may provide a fuel/air ratio of 0.0015 and 0.015 Wf/Wa.

According to systems as in the present invention, where the fuel/air ratio is the same, the burn temperature is the same and the emissions do not change materially. This can also account for differences in ambient temperature which can also affect emissions. In order to realize an increased amount of air into the dilution section 68, a small amount of compressor discharge air may be introduced through a small hole 70 through heat shield 52. This compressor discharge air may be collected in annular casings 72 that form a circumferential plenum surrounding the small holes 70. The annular casings 72 are welded to the outside of the heat shield 52 and may be in direct communication with the engine compressor discharge 81. When activated by a solenoid valve 82, each annular casing 72 fills with high pressure air from the compressor 80. This high pressure air may be forced through holes 70 to form small jets of pressurized air 73 directed in a generally perpendicular direction through the heat shield 52 and against the inner shell 48. This is accomplished in a fluidic fashion where the solenoid valve actuating this flow modulation is remote from the combustor. The holes 70 may be opposing and slightly downstream from holes 60, where downstream is defined with relationship to the airflow 65. The jets of pressurized air 73 may cause a local separation of the boundary layer that is known to be created by the airflow 65 along the outer wall of the inner shell 48 and the inner wall of heat shield 52. Because of the axially staggered juxtaposition of holes 70 and 60, this local separation of the boundary layer results in a small blockage 69 downstream of the dilution holes 60 that will divert more flow 65 to enter the dilution holes 60. Less air therefore enters the premix 64 and premix zones, and more air enters the dilution section 68. This encourages more flow to go Into the dilution holes 60 when power is reduced so that relatively less air flows to the premixer and the fuel/air mixture is maintained. This also helps the stability of the combustor. Finer adjustment of the flow modulation of the jets 73 may be effected with increased annular casings 72 opposite additional rows of dilution holes 60. In addition, turbulation ribs 83 may be situated around the inner casing to further break up the boundary layer.

According to another embodiment a method of modulating the airflow to effectuate a desired fuel/air ratio in a lean premix combustor is disclosed. This method may comprises the steps of reducing power, which reduces fuel flow into the combustor and reducing air into a primary section 66. The inner shell 48 may be cooled by convective cooling. The air into a dilution section may be accomplished by introducing at least one stream of air through a multiplicity of openings in a heat shield that may be interposed between and inner shell and an outer liner. The openings in the heat shield may be downstream from a multiplicity of dilution holes in an inner shell. The stream of air causes a local boundary layer separation to encourage blockage just below the said multiplicity of dilution holes, this in turns encourages air to the dilution holes. More than one row of dilution holes will allow stages reduction of flow to the primary section as power may be reduced. The flow velocity in the flow channel may be relatively high, and has experienced a pressure drop in the recuperator, providing sufficient head to power the boundary layer trip. As such, the dilution holes set the ratio of primary and secondary air flow. This allows for low emissions of $NO_x$ operation at maximum design conditions. As reduced power the fuel flow may be reduced and the fuel/air ratio changes. To maintain a desirable fuel/air ratio, the air into the primary section must be reduced, which may be accomplished by increasing the amount of air entering the dilution holes.

It should be understood, of course, that the foregoing relates to preferred embodiments of the invention and that modifications may be made without departing from the spirit and scope of the invention as set forth in the following claims.

I claim:

1. A gas turbine engine combustion system for varying the fuel/air ratio between a fuel and air, the system comprising:

an inner shell with a premix section, a primary section and a dilution section;

an outer shell accommodating said inner shell;

a heat shield interposed between said outer shell and said inner shell, wherein said heat shield has a multiplicity of small holes;

an annular casing attached to said heat shield and surrounding each of multiplicity of small holes said annular casing containing a pressurized air flow;

a passage between said inner shell and said heat shield; and at least two dilution holes in said dilution section of said inner shell, which allow air to flow into said dilution section.

2. A system as in claim 1, wherein said pressurized air flow is compressor discharge air.

3. A system as in claim 1, further comprising turbulation ribs attached to the inner shell.

4. A system as in claim 1, wherein said multiplicity of small holes are at an angle with respect to said heat shield.

5. A system as in claim 1, wherein a temperature of combustion of the fuel mixed with air in the fuel/air ratio is between 2000 and 4000° F.

6. A gas turbine engine combustion system for varying the fuel/air ratio between a fuel and air, the system comprising:

an inner shell with a premix section, a primary section and a dilution section;

an outer shell accommodating the inner shell;

a heat shield interposed between said outer shell and said inner shell, wherein said heat shield has at least one set of small holes;

an annular casing attached to said heat shield and surrounding said at least one set of small holes, said annular casing containing a pressurized air flow;

an annular passage between said inner shell and said heat shield; and at least one set of dilution holes in said dilution section of said inner shell, wherein said at least one set of small holes in said heat shield are opposite and downstream from said at least one set of dilution holes.

7. A system as in claim 6, wherein said pressurized air flow is compressor discharge air.

8. A system as in claim 6, further comprising turbulation ribs attached to an exterior surface of said inner shell and downstream of said dilution holes.

9. A system as in claim 6, wherein a temperature of combustion of the fuel mixed with air in the fuel/air ratio is between 2000 and 4000° F.

10. A combustion chamber for varying air flow within a lean premix combustor gas turbine engine, comprising:

an inner shell with a premix section, a primary section and a dilution section;

an outer shell accommodating the inner shell;

a heat shield interposed between said outer shell and said inner shell, wherein said heat shield has a first set of small holes and a second set of small holes, wherein said first set of small holes are parallel to said second set of small holes;

a first annular casing attached to said heat shield and surrounding said first set of small holes, said first annular casing containing a first pressurized air flow;

a second annular casing attached to said heat shield and surrounding said second set of small holes, said second annular casing containing a second pressurized air flow;

an annular passage between said inner shell and said heat shield;

a first set of dilution holes in said dilution section of said inner shell, wherein said first set of dilution holes are opposite and downstream from said first set of small holes;

a second set of dilution holes in said dilution section of said inner shell, wherein said second set of dilution holes are opposite and downstream from said second set of small holes; and turbulation ribs attached to the inside of said inner shell and downstream from said dilution holes.

11. A method of modulating the airflow to effectuate a desired fuel/air ratio in a lean premix combustor comprising the steps of;

reducing power, which reduces fuel flow into said combustor;

reducing air into a primary section; and increasing air into a dilution section by introducing at least one stream of air through a multiplicity of openings in a heat shield that is interposed between an inner shell and an outer liner, wherein said openings in said heat shield are downstream from a multiplicity of dilution holes in said inner shell and said at least one stream of air causes a local boundary layer separation to encourage blockage just below the said multiplicity of dilution holes so as to encourage air to enter said multiplicity of dilution holes.

12. A method as in claim 11, wherein said fuel/air ratio is between 0.0015 and 0.015 Wf/Wa.

13. A method as in claim 11, wherein said at least one stream of air is contained within at least one annular casing attached to said heat shield.

14. A method as in claim 11, further comprising the step of pressurizing said stream of air contained within at least one annular casing.

15. A method as in claim 11, wherein said at least one stream of air has an airflow which is controlled by a valve.

16. A method of modulating the airflow to effectuate a desired fuel/air ratio in a lean premix combustor comprising the steps of;

reducing power, which reduces fuel flow into said combustor;

reducing air into a primary section;

cooling an inner shell by convective cooling; and increasing air into a dilution section by introducing at least one stream of air through a multiplicity of openings in a heat shield that is interposed between an inner shell and an outer liner, wherein said openings in said heat shield are downstream from a multiplicity of dilution holes in said inner shell and said at least one stream of air causes a local boundary layer separation to encourage blockage just below the said multiplicity of dilution holes so as to encourage air to enter said multiplicity of dilution holes.

17. A method as in claim 16, wherein said at least one stream of air is contained within an annular casing attached to said heat shield.

18. A method as in claim 16, further comprising the step of pressurizing said stream of air contained within an annular casing.

19. A method as in claim 16, wherein said at least one stream of air has an airflow which is controlled by a valve.

20. A method as in claim 16, wherein said step of cooling an inner shell is augmented by turbulation ribs on said inner shell located downstream of said dilution holes.

* * * * *